US007171877B2

(12) United States Patent
Mosey

(10) Patent No.: US 7,171,877 B2
(45) Date of Patent: Feb. 6, 2007

(54) COMPRESSION TOOL

(75) Inventor: James Richard Mosey, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 21 days.

(21) Appl. No.: 11/103,844

(22) Filed: Apr. 12, 2005

(65) Prior Publication Data

US 2006/0225542 A1 Oct. 12, 2006

(51) Int. Cl.
*B25B 27/30* (2006.01)

(52) U.S. Cl. ..... 81/486; 81/424

(58) Field of Classification Search ..... 81/486, 81/418, 420, 421, 424, 424.5, 426
See application file for complete search history.

(56) References Cited

U.S. PATENT DOCUMENTS 1,234,967 A * 7/1917 Throp ..... 29/221
2,779,224 A * 1/1957 Coggburn ..... 81/3.44
3,383,963 A * 5/1968 Vondrachek ..... 81/423
4,499,796 A * 2/1985 Miller ..... 81/426
4,742,736 A 5/1988 Williams
4,921,368 A 5/1990 Busse et al.
4,942,794 A 7/1990 Snyder et al.
5,022,291 A * 6/1991 McBain ..... 81/424
5,307,541 A 5/1994 Nagano
5,375,299 A 12/1994 Nagano
5,537,727 A * 7/1996 Mayer ..... 29/237
5,791,210 A * 8/1998 Wolff et al. ..... 81/302
6,220,126 B1 * 4/2001 Domenge ..... 81/418
6,389,937 B1 * 5/2002 Kang ..... 81/423
6,668,901 B2 12/2003 Tabellini

* cited by examiner

*Primary Examiner*—David B. Thomas
(74) *Attorney, Agent, or Firm*—Brooks Kushman P.C.

(57) ABSTRACT

A compression tool enables efficient handling, compression, and installation of a compressible component. The compression tool includes a first handle having a proximal end and a working end, wherein the working end has a first engaging member. The tool further includes a second handle pivotally attached to the first handle and having a proximal end and a working end. The working end also includes a second engaging member. The first and second engaging members are maintained in opposed alignment. Furthermore, the first and second engaging members have an orifice defined by an engageable flange portion configured to engage the compressible component.

17 Claims, 2 Drawing Sheets

COMPRESSION TOOL

BACKGROUND OF THE INVENTION

1. Field of the Invention

The present invention relates generally to improved tool and more specifically to improved tool for compressing compressible components.

2. Background Art

The use of substantially rigid, yet flexible components on vibrating machines is common. In many cases, these components are utilized as conduits for the passage of gasses and liquids. It is common for these components to be included in a ducting system such as an exhaust system, wherein the component is attached to other rigid members within the system. An example of such a component is a flexible bellows 10 as shows in FIG. 1. The bellows 10 is configured to maintain an airtight seal with adjacent exhaust system components (e.g., components A and B of FIG. 1) for the passage of gasses or liquids throughout an exhaust system of a vehicle despite engine vibration and movement. Accordingly, bellows 10 is designed to maintain a sufficient amount of rigidity to create the required seal by compressing against the adjacent exhaust components, while maintaining adequate flexibility to withstand engine vibration and movement. To accommodate the foregoing performance demands, bellows 10 is configured to compress and decompress. As shown, bellows 10, which is naturally in the decompressed state, has a length greater than the length of the space in which it is to be installed. Thus, to allow for installation, bellows 10 must be compressed.

As discussed in the foregoing, bellows 10 is a substantially rigid component. As such, compressing bellows 10 for installation requires an appreciable amount of applied force by the installer. Conventionally, the installer compresses bellows 10 by hand. However, this approach has several disadvantages including the inevitable fatigue of the installer's hand as well as the inherent risk of damaging bellows 10 due to mishandling as a result of "bare" hand installation.

Thus, there exists a need for a tool that enables efficient handling and installation of a compressible component on an engine.

SUMMARY OF THE INVENTION

The present invention is directed to a compression tool that enables efficient handling and installation of a compressible component. The compression tool includes a first handle having a proximal end and a working end. The working end includes a first engaging member. The tool further includes a second handle pivotally attached to the first handle and having a proximal end and a working end. The working end also includes a second engaging member. The first and second engaging members are maintained in opposed alignment and have an orifice defined by an engageable flange portion.

The present invention also includes a method for compressing a compressible component. The method includes the step of providing a compression tool having a pivotally connected first and second handle, wherein the first handle includes a first engaging member and the second handle includes a second engaging member. The first and second engaging members have a jaw opening therebetween and each have an orifice defined by an engageable flange portion. The method also includes the step of adjusting the jaw opening between the first and second engaging members to correspond with the compressible component. Another step includes positioning the compressible component within the orifice whereby the flange portions engage the compressible component. Yet another step includes compressing the first and second handles whereby the flange portions compress the compressible component.

BRIEF DESCRIPTION OF THE DRAWINGS

These and other features and advantages of the invention will be apparent from the following detailed description and the appended claims, taken in conjunction with the accompanying drawings, in which:

DETAILED DESCRIPTION OF THE PREFERRED EMBODIMENT(S)

Figure 1:
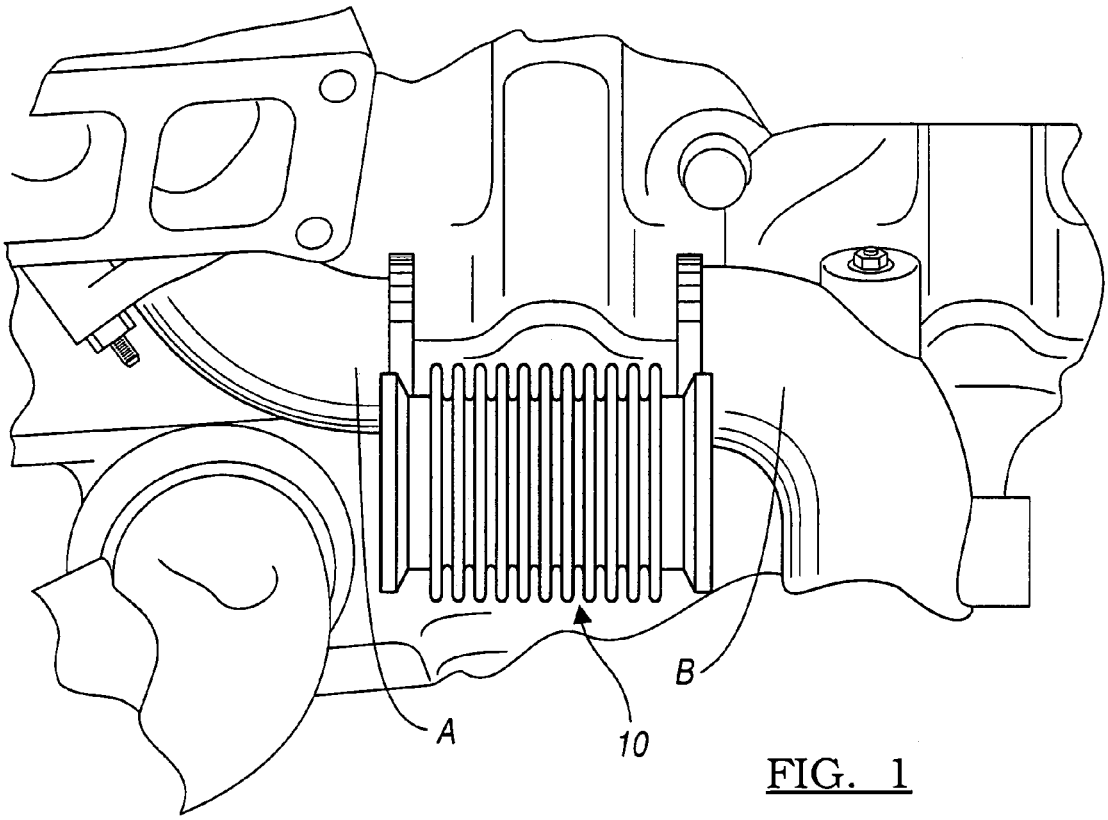
FIG. 1 illustrates a compressible component in close proximity to an area in which the compressible component may be installed.
Figure 2:
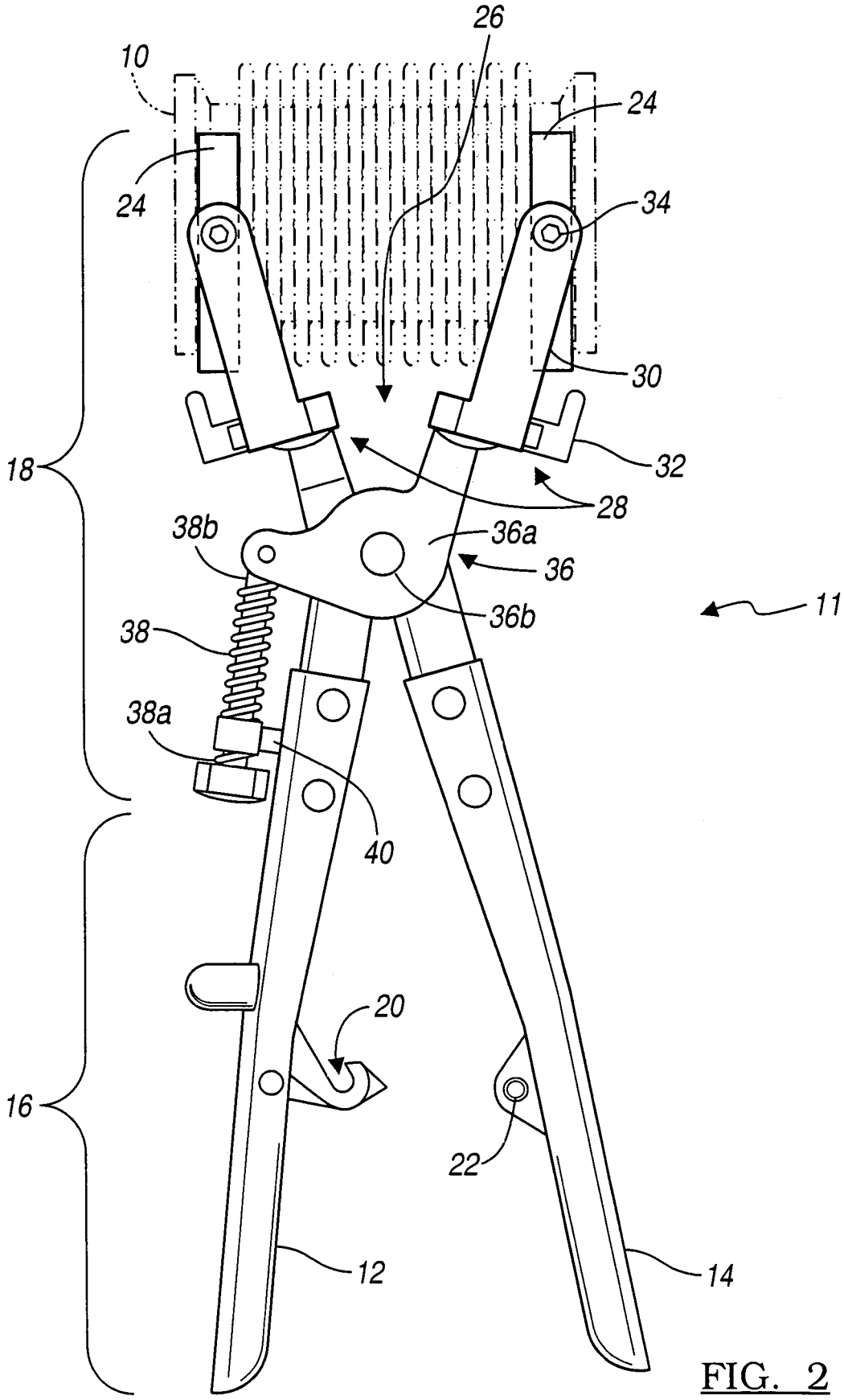
FIG. 2 illustrates a compression tool adapted to install the compressible component of FIG. 1 according to an embodiment of the present invention.

Referring to FIG. 2, a compression tool 11 is illustrated that enables efficient handling and installation of a compressible component. By way of example and not limitation, the compressible component described is represented as the bellows 10 of FIG. 1. It is recognized, however, that compression tool 11 may be adapted or modified for use with virtually any compressible component or member without departing from the scope of the invention. Accordingly, compression tool 11 includes a first handle 12 and a second handle 14. The first and second handles 12 and 14 each have a proximal end 16 and a working end 18.

At proximal end 16 the first and second handles 12 and 14 include a latching mechanism. As such, a latch 20 is connected to first handle 12 and a receiving member 22 is connected to second handle 14. Latch 20 is configured to engage receiving member 22 thereby locking first and second handles 12 and 14. The locking function disables movement of first and second handles 12 and 14.

At working end 18 first and second engaging members 24 are each connected to first and second handles 12 and 14, respectively. Engaging members 24 have a jaw opening 26 therebetween for positioning of a compressible component (e.g., bellows 10 of FIG. 1) within engaging members 24. Jaw opening 26 may be reduced or expanded by positioning first and second handles 12 and 14. During handling and installation of the compressible component (e.g., bellows 10 of FIG. 1), the jaw opening 26 is adjusted to correspond with the length of the compressible component. Accordingly, engaging members 24 are maintained in opposed alignment to securely engage the compressible component.

Figure 3:
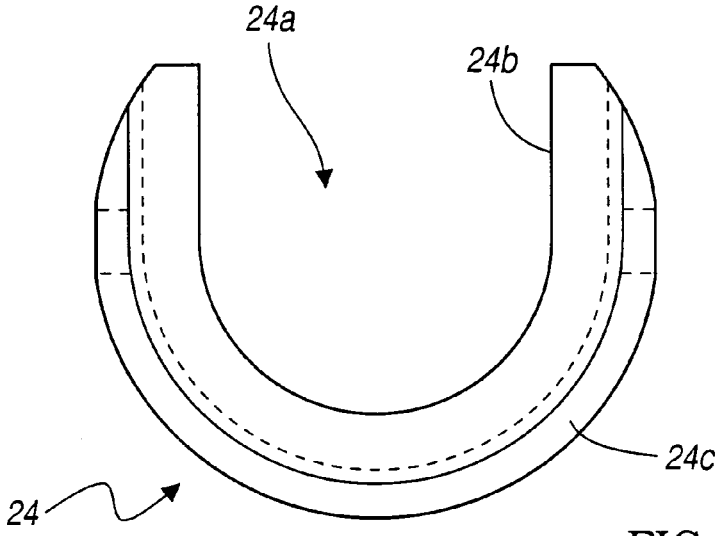
FIG. 3 illustrates an enlarged side view of an engaging member as shown in FIG. 2.

Referring to FIG. 3, an enlarged side view of engaging members 24 is illustrated. As shown, engaging members 24 include an orifice 24*a* that is defined by a flange portion 24*b*. Integrated with flange portion 24*b* is a base portion 24*c*. Orifice 24*a* is configured to have a shape or profile that is complimentary with the shape or profile of the compressible component. Accordingly, in the embodiment shown, the orifice 24*a* defined by flange portion 24*b* has a profile that compliments the shape of the compressible component shown in FIG. 1. It is recognized, however, that the profile of orifice 24*a* and flange portion 24*b* may be adapted and modified without departing from the scope of the present invention. Flange portion 24*b* has a sufficient width and length to engage and compress the compressible component (e.g., bellows 10 of FIG. 1) when an installer compresses (i.e., squeezes) proximal end 16 of first and second handles 12 and 14.

Now referring back to FIG. 2, at working end 18, first and second handles 12 and 14 each include a mounting assembly 28. Mounting assembly 28 is adapted to mount and secure engaging members 24. Accordingly, mounting assembly 28 includes a mounting arm 30 and a biasing bracket 32. Mounting arm 30 attaches engaging members 24 to handles 12 and 14, respectively. In one embodiment, mounting arm 30 is mechanically attached to engaging member 24 through the use of a rivet 34. It is recognized, however, that mounting arm 30 may be attached to engaging member 24 through the use of any suitable attaching device. Biasing bracket 32 biases the angle of engaging member 24 relative to mounting arm 30.

As shown in FIG. 2, a pivot member 36 connects first and second handles 12 and 14. Pivot member 36, in cooperation with first and second handles 12 and 14, enable setting and adjusting of jaw opening 26. As shown, pivot member 36 includes a pivot plate 36*a* and a pivot pin 36*b*. Also connected to pivot member 36 is an adjusting screw 38. Adjusting screw 38 enables precise adjustment of jaw opening 26. Accordingly, at a first end 38*a* of adjusting screw 38 an adjusting screw guide 40 is integrated with first handle 12. At a second end 38*b*, adjusting screw 38 is attached to pivot member 36. Turning adjusting screw 38 causes incremental movement of engaging members 24.

While embodiments of the invention have been illustrated and described, it is not intended that these embodiments illustrate and describe all possible forms of the invention. For example, the invention described herein is in the context of a vehicle engine. However, the present invention may be adapted for use within any environment in which a substantially rigid component or member is to be compressed. Accordingly, the words used in the specification are words of description rather than limitation, and it is understood that various changes may be made without departing from the spirit and scope of the invention.

What is claimed is:

1. A compression tool, comprising:

a first handle having a proximal end and a working end, said working end including a first engaging member;

a second handle pivotally attached to said first handle and having a proximal end and a working end, said working end including a second engaging member;

wherein said first and second engaging members are maintained in opposed alignment, said first and second engaging members having an orifice defined by an engageable flange portion, said flange portion having a base portion integrated therewith; and wherein said base portion has a mounting assembly attached thereto through the use of a mounting arm.

2. A tool according to claim 1, wherein said second handle is pivotally attached to said first handle through the use of a pivot member.

3. A tool according to claim 2, further comprising an adjusting screw having a first and second end being secured to the first handle and the second handle.

4. A tool according to claim 3, wherein said first end is secured by an adjusting screw guide integrated with said first handle and said second end being connected to said pivot member.

5. A tool according to claim 1, wherein said mounting arm attaches to said base portion through the use of a rivet.

6. A tool according to claim 1, wherein said mounting assembly includes a biasing bracket.

7. A tool according to claim 1, wherein said first handle has a latch that is adapted to engage a receiving member connected to said second handle.

8. A method for compressing a compressible component, comprising the steps of:

providing a compression tool having a pivotally connected first and second handle, wherein said first handle includes a first engaging member and said second handle includes a second engaging member, said first and second engaging members having a jaw opening therebetween and each having an orifice defined by an engageable flange portion, said flange portion having a base portion integrated therewith, wherein said first and second engaging members include a mounting assembly comprised of a biasing bracket and a mounting arm, wherein said mounting arm attaches to said base portion;

adjusting the jaw opening between said first and second engaging members to correspond with the compressible component;

positioning the compressible component within said orifice whereby said flange portions engage the compressible component; and compressing said first and second handles whereby said flange portions compress the compressible component.

9. A method according to claim 8, wherein the step of providing said compression tool includes providing an adjusting screw having a first and second end being secured to the first handle and the second handle.

10. A method according to claim 9, wherein the step of providing an adjusting screw having a first and a second end that is secured to the first handle and the second handle includes a first end that is secured by an adjusting screw guide integrated with said first handle and said second handle being connected to a pivot member that pivotally connects said first and second handle.

11. A compression tool, comprising:

a first handle having a proximal end and a working end, said working end including a first engaging member;

a second handle having a proximal end and a working end, said working end including a second engaging member;

wherein said first and second engaging members have a jaw opening therebetween and are maintained in opposed alignment, said first and second engaging members further including an orifice defined by an engageable flange portion; said flange portion having a base portion integrated therewith;

wherein said base portion has a mounting assembly attached thereto, the mounting assembly being attached to said base portion through the use of a mounting arm; and a pivot member connecting said first handle to said second handle, said pivot member enabling setting and adjusting of the jaw opening between said first and second engaging members.

12. A tool according to claim 11, wherein said mounting arm attaches to said base portion through the use of a rivet.

13. A tool according to claim 11, wherein said mounting assembly includes a biasing bracket.

14. A tool according to claim 11, wherein said pivot member includes a pivot pin.

15. A tool according to claim 11, wherein said pivot member includes a pivot plate.

16. According to claim 11, wherein said first handle has a latch that is adapted to engage a receiving member connected to said second handle.

17. A tool according to claim 11, further comprising an adjusting screw having a first and second end, said first end being secured by an adjusting screw guide integrated with said first handle and said second end being connected to said pivot member.

* * * * *